US010287712B2

(12) United States Patent
Serena et al.

(10) Patent No.: US 10,287,712 B2
(45) Date of Patent: May 14, 2019

(54) SHED FORMING MACHINE AND LOOM INCLUDING SUCH A MACHINE

(71) Applicant: STAUBLI FAVERGES, Faverges (FR)

(72) Inventors: Claude Serena, Gilly sur Isere (FR); Francois Pollet, Annecy le Vieux (FR)

(73) Assignee: STAUBLI FAVERGES, Faverges (FR)

( * ) Notice: Subject to any disclaimer, the term of this patent is extended or adjusted under 35 U.S.C. 154(b) by 112 days.

(21) Appl. No.: 15/653,744

(22) Filed: Jul. 19, 2017

(65) Prior Publication Data

US 2018/0023223 A1 Jan. 25, 2018

(30) Foreign Application Priority Data

Jul. 22, 2016 (FR) ..... 16 57057

(51) Int. Cl.
*D03C 3/32* (2006.01)
*D03C 1/16* (2006.01)
(Continued)

(52) U.S. Cl.
CPC ..... *D03C 1/16* (2013.01); *D03C 1/14* (2013.01); *D03C 5/00* (2013.01); *D03D 47/267* (2013.01);
(Continued)

(58) Field of Classification Search
CPC ..... D03C 3/20; D03C 3/205; D03C 13/00; D03C 1/144; D03C 1/16; D03C 3/32;
(Continued)

(56) References Cited

U.S. PATENT DOCUMENTS 2,932,901 A * 4/1960 Salem et al. ..... F26B 7/00 26/106
3,856,055 A * 12/1974 Hirsch ..... D03D 35/00 139/138
(Continued)

FOREIGN PATENT DOCUMENTS

CN 201424542 3/2010
CN 203320221 12/2013
(Continued)

OTHER PUBLICATIONS

French Search Report (FR1657057) dated Apr. 3, 2017.

*Primary Examiner* — Robert H Muromoto, Jr.

(57) ABSTRACT

A machine for forming the shed of a weaving loom, of the dobby or cam machine type utilizes output levers performing, during the weaving, an alternating oscillation movement around another common shaft, a casing (12) with an output aperture crossed by the levers, as well as a frame (6) which delimits, with the casing (12), an inner volume (V) of the machine, including an area for receiving torque transmission members between a driving shaft and a shaft for actuating the output levers as well as an area for receiving the output levers, this receiving area being adjacent to the area for receiving the torque transmission members, while the frame (6) supports the actuation shaft. The casing (12) and the frame (6) are in sealed contact, via at least one seal gasket (16, 18), at both external (16) and internal (18) seal barriers (B1, B2) respectively distant from each other, both seal barriers each extending over the whole periphery of the casing (12) except at the output aperture.

15 Claims, 13 Drawing Sheets

(51) Int. Cl.

| | |
|---|---|
| ***D03D 47/26*** | (2006.01) |
| ***D03D 51/46*** | (2006.01) |
| ***D03C 1/14*** | (2006.01) |
| ***D03C 5/00*** | (2006.01) |
| *D03C 9/06* | (2006.01) |
| *D03C 5/04* | (2006.01) |
| *D03C 13/00* | (2006.01) |

(52) U.S. Cl.
CPC ..... *D03D 51/46* (2013.01); *D03C 1/146* (2013.01); *D03C 5/04* (2013.01); *D03C 13/025* (2013.01)

(58) Field of Classification Search
CPC ..... D03C 3/44; D03C 5/02; D03C 13/025; D03C 5/00; D03C 13/02; D03C 1/14; D03C 1/142; D03C 3/26; D03C 9/0683; D03C 9/00; D03D 49/02; D03D 51/007
See application file for complete search history.

(56) References Cited

U.S. PATENT DOCUMENTS 4,513,789 A * 4/1985 Bowen, Jr. ..... D03C 3/44 139/59
4,635,684 A * 1/1987 Hintsch ..... D03D 47/24 139/1 R
4,694,866 A * 9/1987 Kuo-Ching ..... D03D 37/00 139/458
4,766,935 A * 8/1988 Tanaka ..... D03C 5/005 139/55.1
5,094,274 A * 3/1992 Bucher ..... D03C 9/00 139/82
5,452,590 A * 9/1995 Vigili ..... D04B 15/99 310/156.57
5,642,758 A * 7/1997 Palau ..... D03C 1/16 139/57
5,647,402 A * 7/1997 Palau ..... D03C 1/14 139/1 R
6,050,305 A * 4/2000 Braun ..... D03C 3/20 139/455
6,058,983 A * 5/2000 Bourgeaux ..... D03C 3/20 139/455
6,237,213 B1 * 5/2001 Braun ..... D03C 3/20 29/596
6,293,315 B1 * 9/2001 Froment ..... D03C 3/20 139/455
6,367,512 B2 * 4/2002 Feer ..... D03C 3/44 139/1 C
6,397,897 B2 * 6/2002 Fumex ..... D03C 9/0683 139/57
6,708,731 B1 * 3/2004 Lamprillo ..... D03D 51/34 139/370.2
6,834,681 B2 * 12/2004 Wahhoud ..... D03C 3/20 139/1 E
6,863,091 B2 * 3/2005 Wahhoud ..... D03C 3/20 139/435.1
7,025,094 B2 * 4/2006 Vanderjeugt ..... D03C 3/44 139/59
7,040,352 B2 * 5/2006 Dagois ..... D03C 3/20 139/59
7,730,910 B2 * 6/2010 Communal ..... D03C 13/00 139/102
9,121,116 B2 * 9/2015 Champion ..... D03C 13/02
9,873,961 B2 * 1/2018 Cittadini ..... D03C 5/005
2004/0261882 A1 * 12/2004 Dagois ..... D03C 3/20 139/59
2005/0241718 A1 * 11/2005 Froment ..... D03C 9/0675 139/91
2007/0035129 A1 * 2/2007 Chappaz ..... F16L 37/23 285/308
2008/0178960 A1 * 7/2008 Communal ..... D03C 13/00 139/455

FOREIGN PATENT DOCUMENTS

| | | |
|---|---|---|
| CN | 203360701 | 12/2013 |
| EP | 2492381 | 8/2012 |

* cited by examiner

SHED FORMING MACHINE AND LOOM INCLUDING SUCH A MACHINE

The present invention relates to a shedding machine of the dobby or cam machine type, for a loom as well as to a loom, comprising such a machine for forming the shed.

In the field of weaving, the use of machines for forming the shed is known, which have a group of output levers rotatably mounted around a common shaft. The different shafts, the levers as well as the different mechanical connections which connect them together are supported by a frame of the machine and covered with a removable protective casing. The extensions of the output levers extend through a recess of a casing towards the outside of the machine.

Taking into account the operating speeds which are increasingly high of these machines, oil contained in the machine for forming the shed is used for lubricating joints with bearings supporting the different mechanical connections of the machine, but leaks outwards have to be excluded, in order to avoid dirtying of the fabric during its making on the loom. The high speed movement of the levers may produce projections of oil.

In the known machines for forming the shed, a seal gasket between the casing and the frame extends in contact with the upper end of the frame and a seal gasket extends around the output aperture of the levers. These gaskets form a single seal barrier between the outside and the inside of the machine. In order to limit projections of oil, baffles or internal casings are added in the inner volume of the machine around the levers and around the driving system.

However, from the moment that the same seal gasket should ensure a seal to external pollutions, such as the textile lint, and a seal to an oil mist coming from the inside of the machine, it happens that the lint comes into contact with the oil. The lint then attracts the oil contained in the tank of the frame by capillarity, which generates oil leaks detrimental to the cleanliness of the fabric and a lack of oil in the tank altering the operation of the mechanical members of machine for forming shed. The seal of this type of machine for forming shed may therefore be improved.

These are the drawbacks which are intended to be remedied by the invention by proposing a novel machine for forming the shed for which the seal to external pollutions and to the oil contained in the inside of the machine is improved.

For this purpose, the invention relates to a machine for forming the shed, of the dobby type or cam machine type, for a weaving loom, the machine comprising:

- output levers moving, during weaving, with an alternate oscillation movement around a common shaft,
- a casing with an output aperture crossed by the levers,
- a frame which delimits, with the casing, an inner volume of the machine, comprising an area for receiving torque transmission members between a driving shaft and a shaft for actuating the output levers as well as an area for receiving the output levers, this reception area being adjacent to the area for receiving the torque transmission members and the frame supporting the actuation shaft.

According to the invention, the casing, the frame are in contact via at least one seal gasket, at both seal barriers respectively external and internal barriers distant from each other, both seal barriers each extending over the whole periphery of the casing except at the output aperture.

By means of the invention, any contact between the lint coming from the outside of the machine and the oil mist coming from the inner volume of the machine is avoided by means of two distant seal barriers and of the intermediate chamber existing between both seal barriers. The exit of oil on the outside of the machine by capillarity is therefore avoided.

According to advantageous aspects but non-mandatory of the invention, such a machine may incorporate one or several of the following characteristics, taken according to any technically acceptable combination:

- The internal and external seal barriers are positioned in parallel with each other.
- A first seal gasket forms the external seal barrier and a second seal gasket forms the internal seal barrier.
- At least one seal gasket of the external and internal seal barriers has a recessed end able to be deformed between the casing and the frame.
- The recessed end defines a closed profile having two internal centering geometries adapted for cooperating with each other by complementarity of shapes when the recessed end is deformed between the casing and the frame.
- At least one or each seal gasket of the external and internal seal barriers comprises a base housed in a peripheral groove of the casing.
- The groove(s) open along a direction for mounting the casing on the frame.
- The external seal barrier is made between a peripheral surface of a horizontal end of an edge of the frame and a peripheral end surface of an edge of the casing.
- The internal seal barrier is made between a side peripheral surface of an edge of the frame and a peripheral side surface of an internal edge of the casing.
- The seal gasket forming the internal seal barrier comprises a base inserted into a groove of the casing and a tab extending from the base as far as one end of this tab in contact with the frame, the surface of this tab flattened against the internal edge of the casing in a mounted configuration forming, at the free end of the seal gasket, an angle with the base strictly less than 180°, preferably equal to 175°.
- The external seal barrier and the internal seal barrier are shifted along a mounting direction of the casing on the frame. The casing includes an internal rib, forming a shell shifted inwards relatively to the internal seal barrier, this internal rib extending at least at the rear of the area for receiving the levers in the frame and between the area for receiving the levers and the driving area.
- The casing is attached on the frame by shouldered screws, a seal gasket being interposed between each shouldered screw and the casing.
- At least one of the shouldered screws is inserted into an orifice of the casing for which the edges have a chamfer, and while the joint ensuring the seal between this shouldered screw and the casing is pressed between a head of this shouldered screw and said chamfer.
- At least one of the shouldered screws comprises an insert surrounding a body of the screw, the insert being inserted between a head of the screw and the casing as well as between the head of the screw and the frame when the body of the screw is engaged in the frame, and when a seal gasket is interposed between the body of the screw and the insert.

The invention also relates to a weaving loom which comprises a machine for forming the shed as mentioned above.

The invention will be better understood and other advantages thereof will become more clearly apparent in the light of the description which follows, of a machine for forming the shed according to its principle, made as a non-limiting example with reference to the appended drawings wherein.

The machine 2 for forming the shed illustrated in FIGS. 1 to 8 is of the dobby type and comprises a driving shaft 4, intended to be driven into rotation by driving means of a weaving loom not shown. The driving shaft 4 is supported by a frame 6 of the machine 2. The machine 2 also comprises a cylindrical actuation shaft 9 visible in FIG. 1, which is also supported by the frame 6 and is driven into rotation, around its own axis X9 and relatively to the frame 6, from the rotation of the driving shaft 4. The shaft 4 and the shaft 9 are perpendicular to each other and connected through transmission means not visible in the figures, but known per se.

Figure 1:
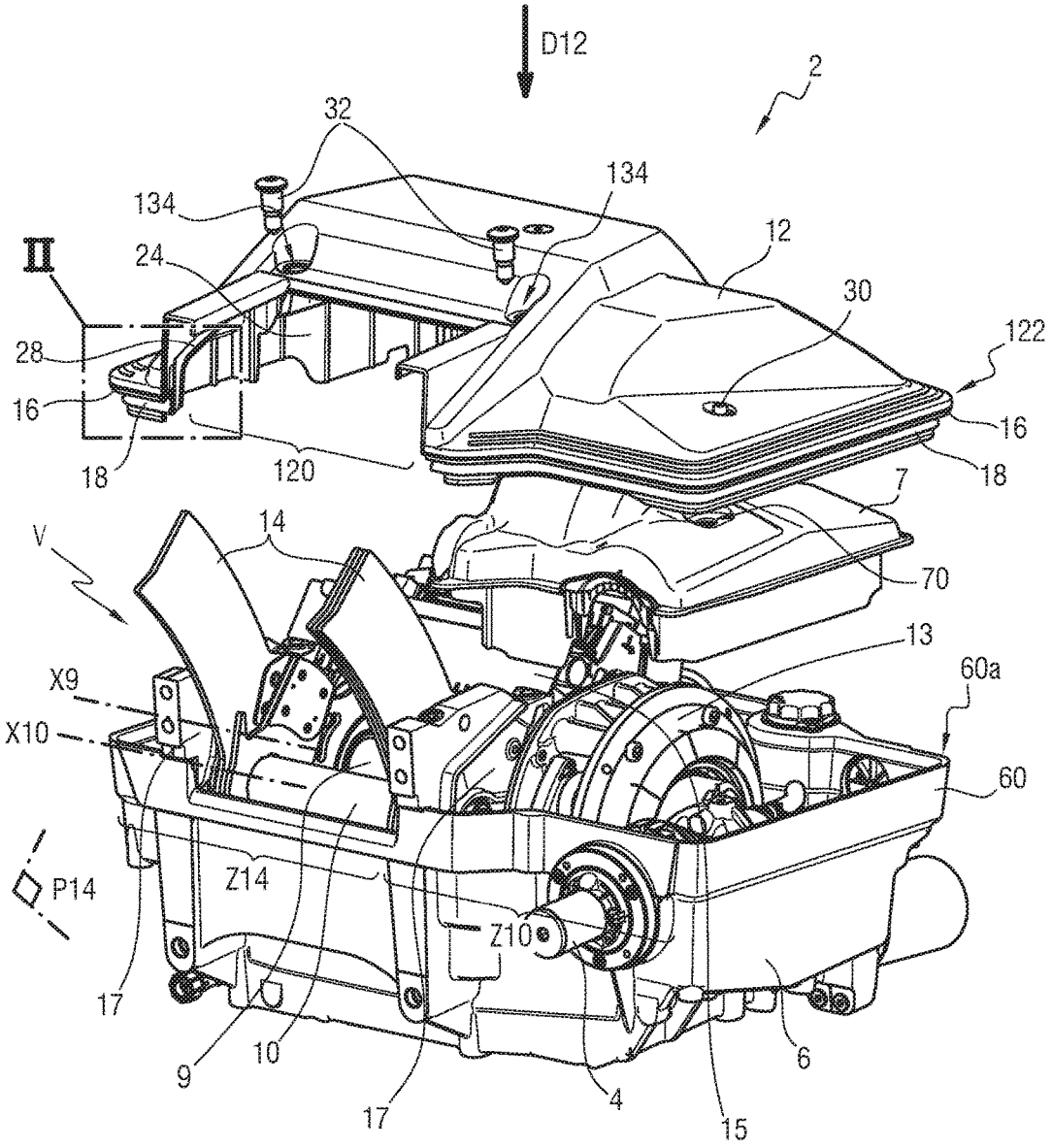
FIG. 1 is a partly exploded perspective view of a machine for forming the shed according to a first embodiment of the invention.
Figure 2:
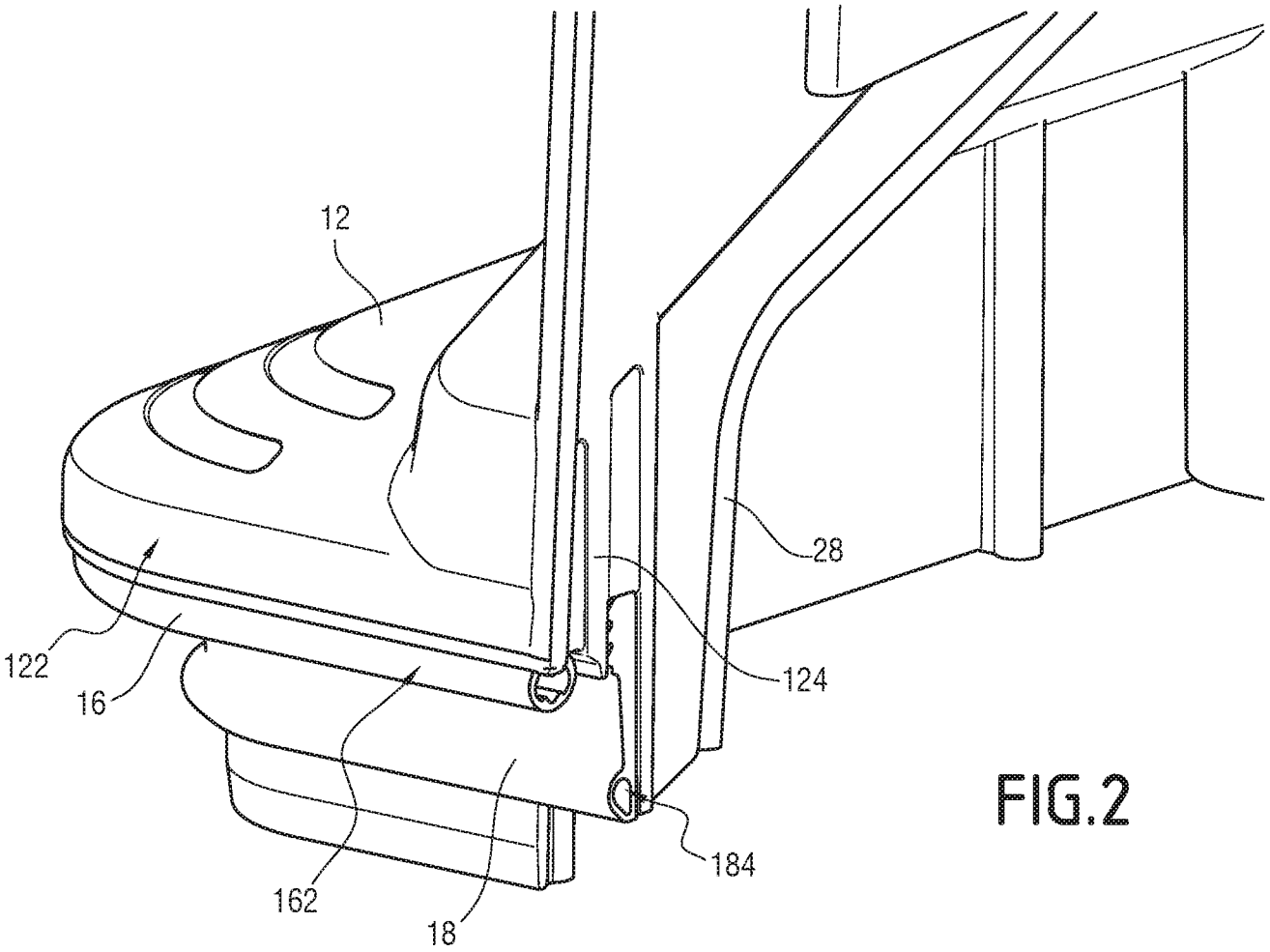
FIG. 2 is a view at a larger scale of the detail II in FIG. 1.
Figure 3:
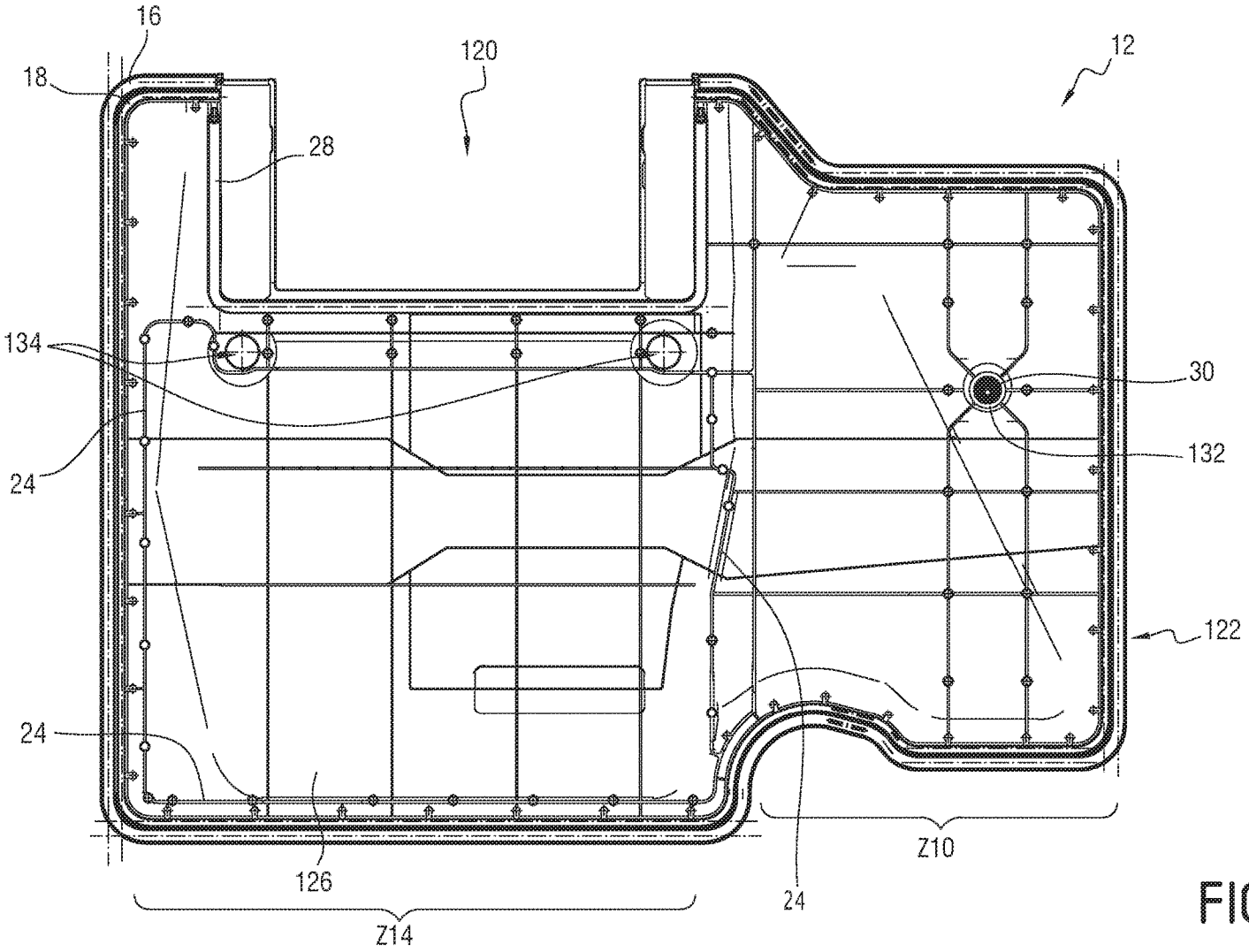
FIG. 3 is a bottom view of a casing of the machine of FIG. 1.

The machine 2 also comprises output levers 14 which are rotatably mounted on a common axis 10, independently of each other, around the longitudinal axis X10 of the shaft 10. The actuation shaft 9 is parallel to the common shaft 10. The levers 14 each extend in a plane P14 orthogonal to the axis X10. In FIG. 1, only four levers 14 are illustrated. The number of levers 14 mounted on the shaft 10 may be adapted according to the type of weaving loom to which the machine 2 is integrated and to the pattern of the fabric to be weaved on this loom.

Each of the levers 14 may be selectively moving with an alternate oscillation movement around the common shaft 10 from the rotation of the shaft 9. The shaft 9 is therefore a shaft for actuating the levers 14 through driving means mounted around the shaft 9, not visible in the figures but known from EP0851045 or EP1845181.

For convenience, the present description is oriented according to FIG. 1, the terms of "high" and "upper" referring to a direction oriented towards the top of FIG. 1, the terms of "low" and "lower" referring to an opposite direction. The term of "axial" as for it refers unless indicated otherwise, an orientation parallel to the axis X10. A side direction is defined as being a direction transverse to a mounting direction D12 of the casing 12 on the frame 6, which is substantially perpendicular to the shafts 4 and 10. By "internal", is meant an element of the machine shifted inwards from the machine. By "external", an element of the machine shifted towards the outside of the machine.

The frame 6 forms a lower support with the shape of a tank. The machine 2 also comprises a casing 12 mounted removably on the frame 6 so as to delimit with the latter an inner volume V of the machine 2, within which are mounted the shafts 4, 9 and 10 and the means for driving the levers 14. The casing 12 is thus positioned in the upper portion of the machine 2. In practice, the shaft 4 is partly mounted in the volume V since it juts out on the outside of the frame 6, as visible in FIG. 1. Two plates 17 for supporting the shaft 9 and the shaft 10 and a crosspiece 15 secured to the frame 6 as well as a modulator 13 interposed between the driving shaft 4 and the actuation shaft 9 are also installed in the volume V.

The machine 2 comprises lubrication means, for example an oil bath in the tank of the frame 6 supplying an oil circuit, mechanical elements positioned within the volume V, notably the bearings for guiding the shafts 4, 9 and 10. Oil thereby circulates in the inner volume V.

The casing 12 is preferably made in an injected plastic material, and includes a wall 126 which will cover the whole frame 6 and the internal elements of the machine 2, notably the levers 14, as well as other elements for which the characteristics will not be detailed hereafter, such as the modulator 13 or a device for selectively driving the levers. The casing 12 comprises an aperture 120 for letting through the levers 14 from the inner volume V to the outside of the machine 2, for the connection of each lever 14 to a connecting rod not shown for transmitting the movement to a frame also not shown of the weaving loom, which is only represented in the figures by its machine 2. The levers 14 extend towards the outside of the machine 2 and are moving, during the weaving, with an alternating oscillation movement around the common shaft 10.

Figure 4:
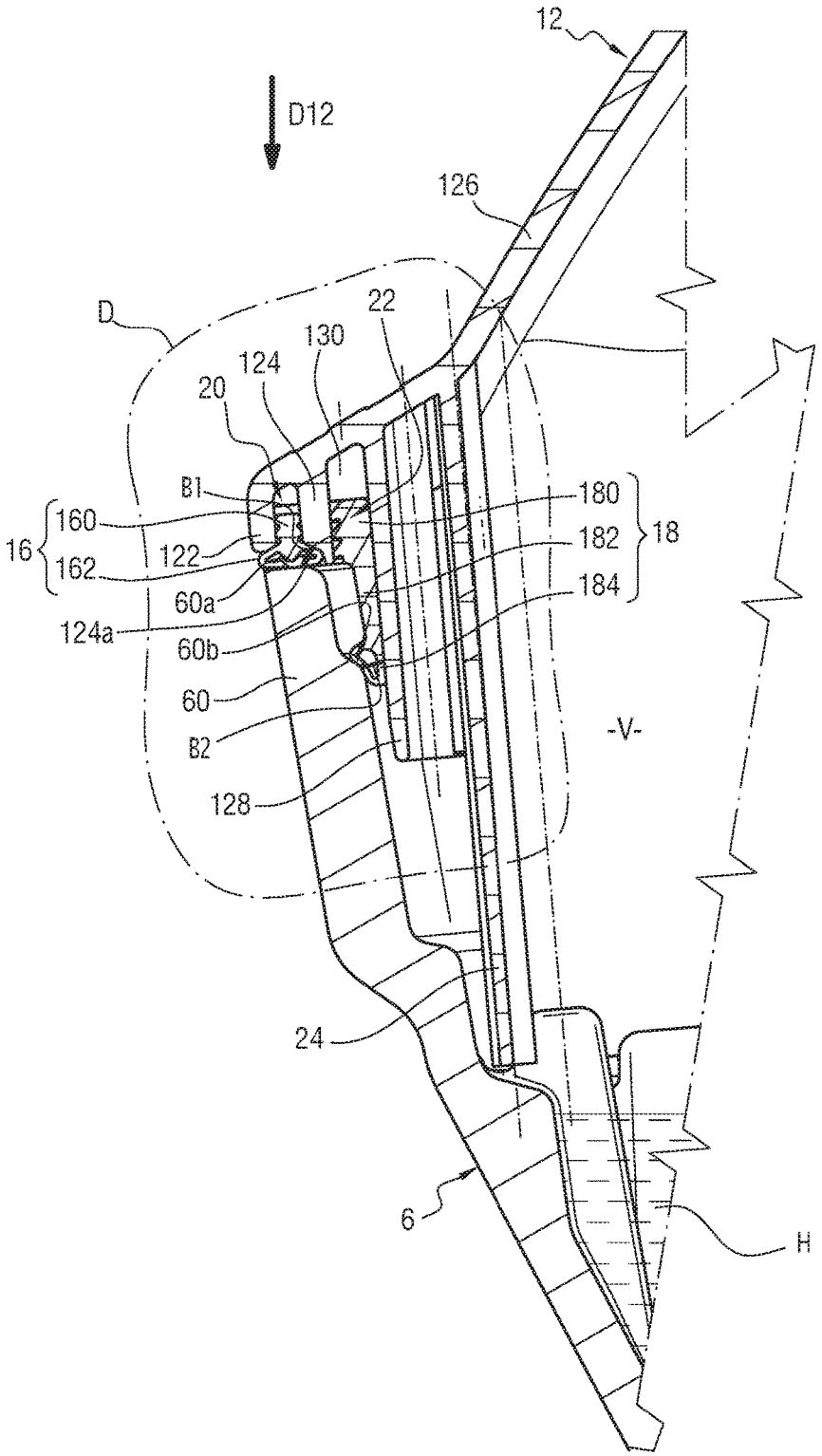
FIG. 4 is a sectional view of a portion of one side of the machine of FIG. 1.

The frame 6, preferably made in cast iron, has a peripheral edge 60 for which the thickness varies but for which the height is greater at the oil bath H visible in FIG. 4. The frame 6 and the casing 12 delimit an area Z14 for receiving the levers 14 and a driving area Z10 for receiving torque transmission members between the driving shaft 4 and the shaft 9, at the driving shaft 4 and the modulator 13. The area of the levers Z14 and the driving area Z10 form the inner volume V. The area of the levers Z14 is positioned beside the driving area Z10 along the axis X10. In other words, the areas Z10 and Z14 are adjacent. The actuation shaft 9 extends in the area of the levers Z14.

Figure 5:
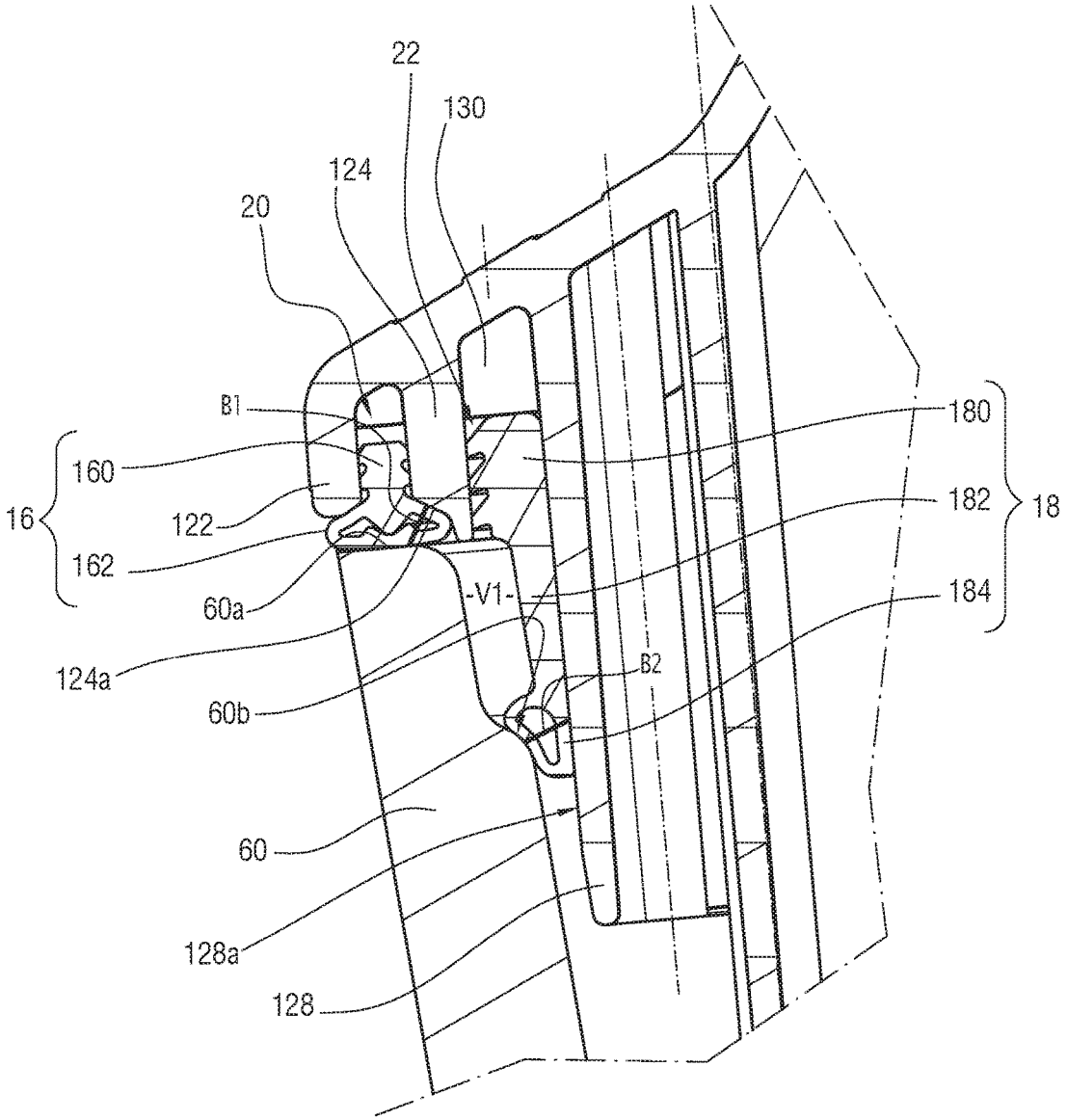
FIG. 5 is a view at a larger scale of the detail D in FIG. 4.

The casing 12 and the frame are in contact at both seal barriers B1 and B2 external and internal respectively, distant from each other, both seal barriers B1 and B2 each extend over the whole periphery of the casing 12 except at the passage aperture 120. Both seal barriers B1 and B2 are made with two distinct seal gaskets 16 and 18, respectively accommodated in a first peripheral groove 20 and a second peripheral groove 22 of the casing 12, and in contact with the frame 6 and the casing 12. In FIG. 5, both seal barriers B1 and B2 are schematically each illustrated by a thick line and form an obstacle to the passage of oil or of lint. The external B1 and internal B2 seal barriers are distant along the lateral direction, and are positioned in parallel with each other. In other words, a substantially constant distance separates both internal and external seal barriers all along the seal barriers. This stems from the constant geometries of the frame 6, of the casing 12 and of the gaskets 16 and 18 along the seal barriers B1 and B2. The first peripheral groove 20, a so called external groove, follows the whole contour of the casing 12, including at the driving area Z10, except at the passage aperture 120 of the levers 14. The first peripheral groove 20 is delimited between an external edge 122 of the casing 12, and an intermediate edge 124 of the casing 12 and extends from the wall 126 of the casing 12. The second peripheral groove, a so called internal groove 22, is adjacent to the first groove 20 and follows the whole external peripheral groove 20 in order to extend over the whole contour of the casing 12, including at the driving area Z10, except at the passage aperture 120 of the levers 14. The second peripheral groove 22 is formed between the intermediate edge 124 and an internal edge 128. The edges 122, 124 and 128 extend in parallel and the groove 22 is positioned in parallel with the external groove 20. The internal edge 128 is positioned towards the inside of the machine 2 relatively to the intermediate edge 124 and extends over a much larger distance in the inner volume V as the intermediate edge 124. As an example, the intermediate edge may extend over a height of 2.5 mm, while the internal edge 128 may extend over a length of 30 mm. Bridges of material 130 formed between the intermediate 124 and internal 128 edges are provided at regular intervals in the second peripheral groove 22. These bridges of material 130 are notably illustrated in FIGS. 2 and 4.

The casing 12 also comprises an internal rib 24 which delimits an internal shell which will continuously surround the area of the levers Z14, except at the output aperture 120. The internal rib 24 follows, at the rear of the area of the levers Z14, on the opposite side to the passage aperture of the levers 120, and on the side opposite to the driving area Z10, the internal edge 128 in a parallel way. The internal rib 24 is at this level more prominent than the internal edge 128 and than the external edge 122. The internal rib 24 also extends transversely to the internal edge 128 and to the external edge 122 for forming a delimitation between the area of the levers Z14 and the driving area Z10, as this is visible in FIG. 3.

The casing 12 also comprises a U-shaped groove 26 made around the output aperture 120, opening into the direction D12 towards the inside of the machine and accommodating a third seal gasket 28.

Figure 7:
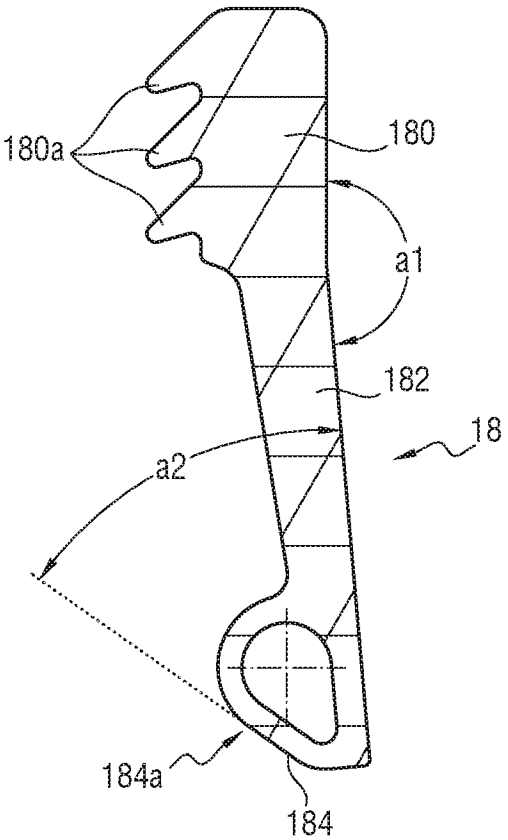
FIG. 7 is a sectional view of a second gasket of the machine of FIG. 1, in a free configuration.
Figure 6:
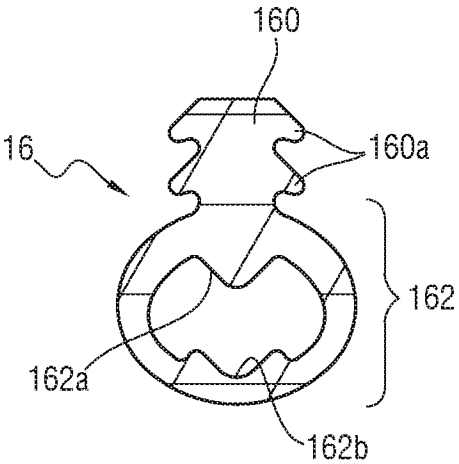
FIG. 6 is a sectional view of a first gasket of the machine of FIG. 1, in a free configuration.

At least one of the seal gaskets 16 and 18 has a recessed end. In FIGS. 6 and 7, the gaskets 16 and 18 are illustrated in a free configuration, i.e. not mounted in the casing 12, the gaskets therefore not being deformed.

The first seal gasket 16 illustrated in FIG. 6 is formed with an extruded silicone profile. The profile comprises a base 160 provided with lugs 160*a* on each side forming profiles as "a fir tree" which allows its insertion and its anchoring into the corresponding groove 20. The base 160 extends in a recessed end 162 able to deform in contact with the frame 6. The recessed end 162 is wider than the base 160, which gives the possibility of positioning the first gasket 16 in the first groove 20 with the recessed end 162 in abutment against the external edge 122 and against the intermediate edge 124 as this is visible in FIGS. 4 and 5. The recessed end 162 defines a closed and hollow profile having two internal centering geometries 162*a* and 162*b* adapted for cooperating with each other by complementarity of shapes along the mounting direction D12.

The second seal gasket 18 comprises a base 180 and a tab 182. The base 180 comprises lugs 180*a* forming a profile "as a fir tree" adapted for being inserted and anchored in the groove 22. The tab 182 ends with an end 184 with a closed and hollow profile. In the free condition illustrated in FIG. 7, the tab 182 is open, i.e. tilted relatively to a wall of the base 180 according to an angle a1 which may for example be 175°, the angle a1 being taken out of the material of the gasket 18. When the base 180 of the second joint 18 is mounted in the second peripheral groove 22, the tab 182 is therefore elastically flattened against the lateral peripheral surface 128*a* of the internal edge 128 of the casing 12. The recessed end 184 has a face 184*a* tilted according to an angle a2 relatively to the surface of the tab 182 in contact with the internal edge 128 when the gasket 18 is in the free condition. The angle a2 may be comprised between 40 and 60°.

The third seal gasket 28 has a geometry identical with that of the first gasket 16 with its base anchored in the groove 26 in a mounted configuration of the gasket 28.

The extruded profile of the seal gasket 16 is cut out to the length corresponding to the length of the external peripheral groove 20 and gasket 16 is placed in the external peripheral groove 20 of the casing 12.

The extruded profile of the seal gasket 18 is cut to the length corresponding to the length of the internal peripheral groove 22, the length of the gasket 18 being in fact less than the length of the gasket 16, and the gasket 18 is placed in the internal peripheral groove 22 of the casing 12.

During the setting into place of the casing 12 on the frame 6, a deflecting casing 7 is preferably set into place around mechanical components of the driving area Z10. The casing 12 is then set into place on the frame 6, in the vertical direction, which corresponds to the mounting direction D12, and then shouldered screws are inserted into three housings crossing the casing 12 and in the frame 6. Some of these shouldered screws are intended to remain mounted on the casing 12 when the latter is subsequently disassembled from the frame 6.

Figure 8:
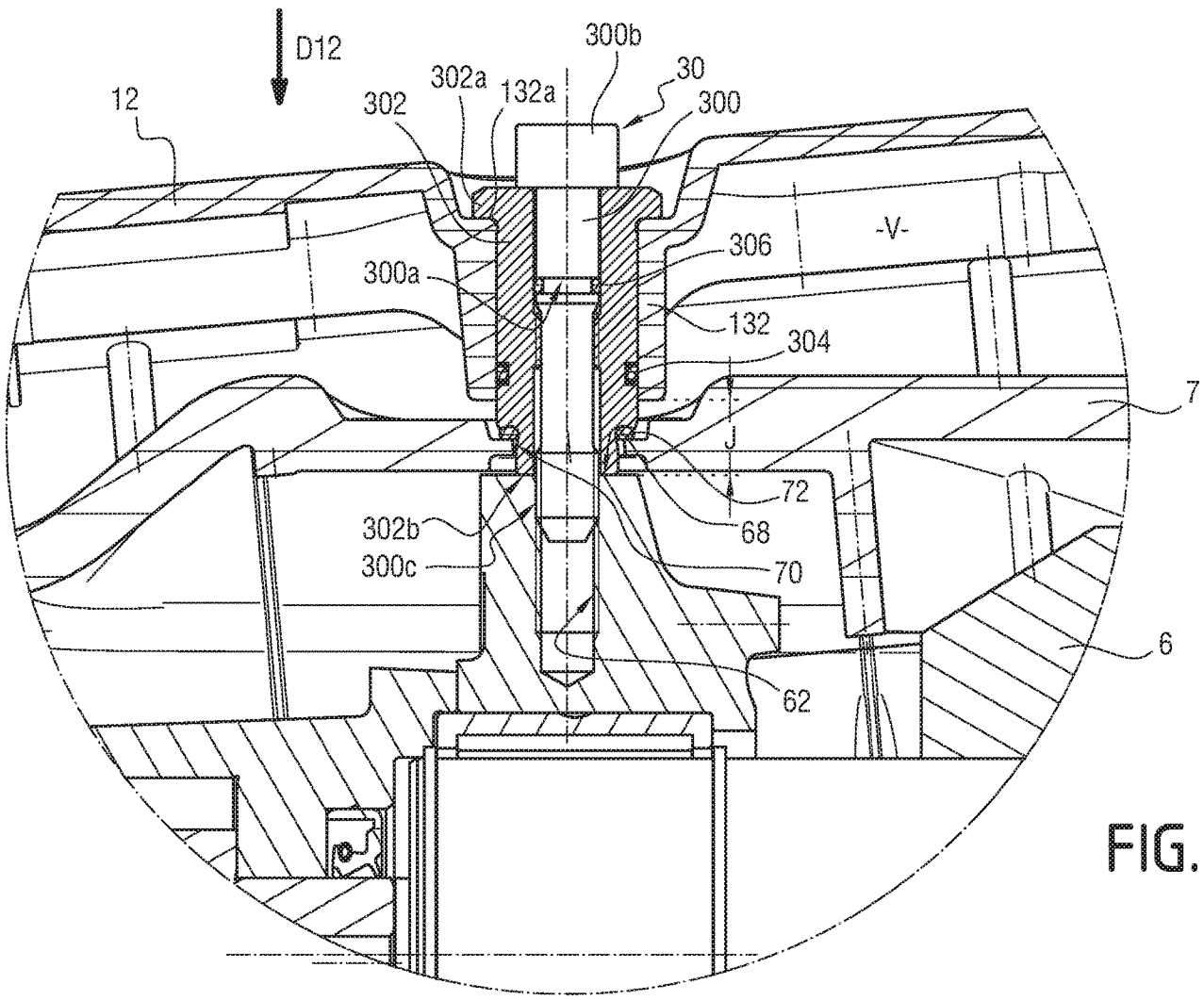
FIG. 8 is a sectional view illustrating an attachment with screws of the machine of FIG. 1.
Figure 9:
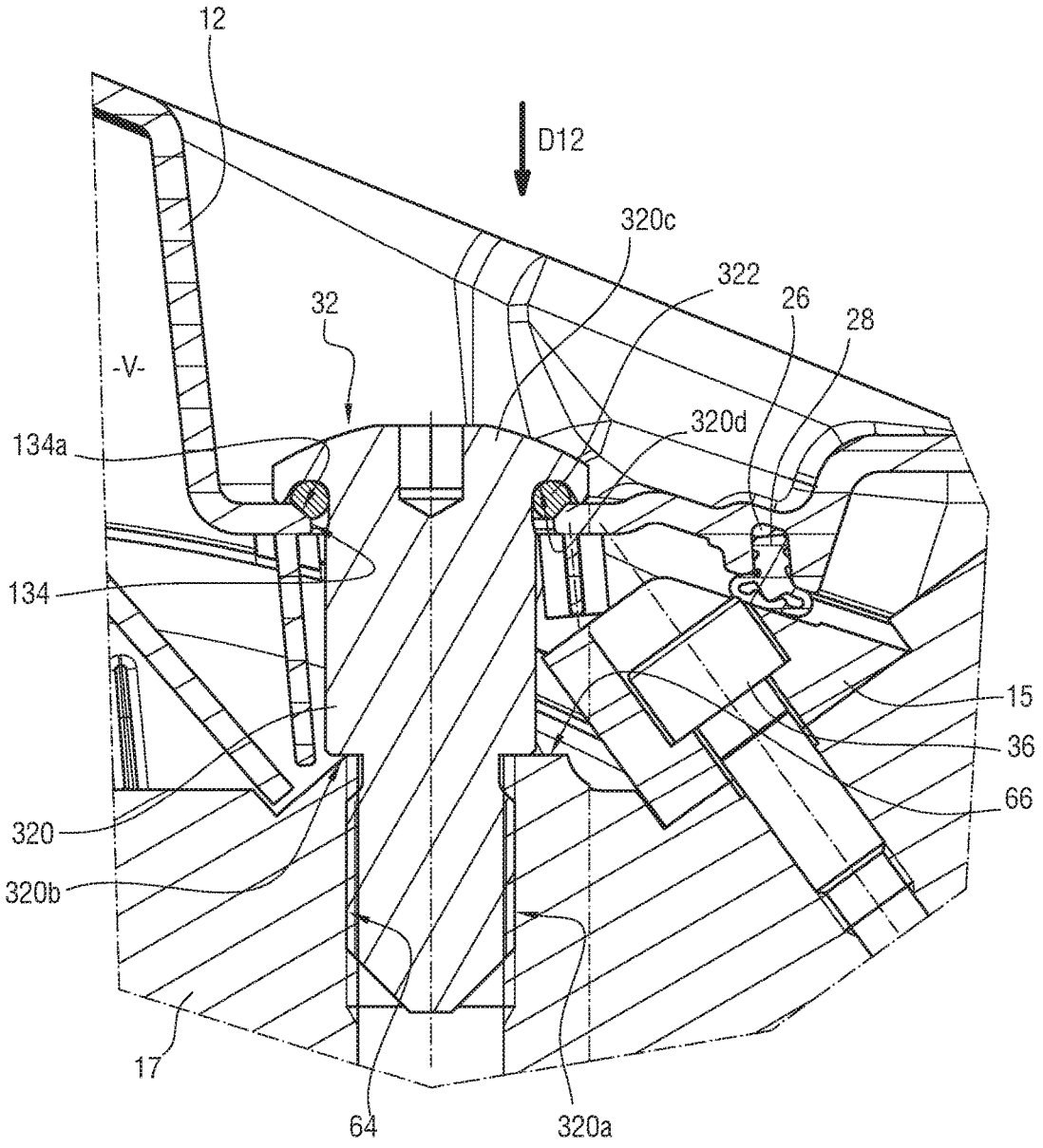
FIG. 9 is a sectional view illustrating a second attachment with screws of the machine of FIG. 1.

As this is illustrated in FIG. 8, in the driving area 210, the machine 2 comprises an attachment screw 30 formed by a screw body 300 and an insert 302 positioned around the screw body 300. The screw body 300 and the insert 302 remain accommodated in the casing 12 when the casing 12 is disassembled. The screw 30 is mounted in a housing 132 of the casing 12 which forms a cylindrical protrusion extending in the inner volume V. The insert 302 has a cylindrical shape mating the internal cylindrical shape of the housing which centers the casing 6 on the screw 30, therefore on the frame 6 when the screw 30 is engaged with the frame 6, which guarantees optimum supports of the seal gaskets 16 and 18 against the frame 6. An O-ring 304 accommodated in an external peripheral groove of the insert 302 is interposed between the insert 302 and the housing 132 and ensures the radial seal between the insert 302 and the housing 132. The radial seal between the screw 30 and the casing 12 is therefore achieved.

An O-ring 306 accommodated in a groove 300*a* of the screw body 300 is interposed between the screw body 300 and the insert 302 and ensures the radial seal between the screw body 300 and the insert 302. The insert 302 is interposed between the head 300*b* of the screw body 300 and the casing 12. The screw body 300 has a threading 300*c* brought so as to be engaged into a tapping 62 of the frame 6.

The insert 302 has a shoulder 302*a* which rests on an external surface 132*a* of the housing 132. The insert 302 is in contact with the frame 6 through its end 302*b* opposite to the shoulder 302*a*. The insert 302 forms a spacer between the head of the screw body 300*b* and the frame 6 when the screw 30 is tightened. The insert 302 therefore positions the casing 12 relatively to the frame in the direction D12 and centers the casing 12 relatively to the frame in a lateral direction, transverse to the direction D12 by cooperating with the elongated housing 132 for guaranteeing placement and accurate centering of the casing 12 relatively to the frame 6 and optimal supports of the seal gaskets 16 and 18 against the frame 6.

The screw 300 is screwed into the frame 6 through an orifice 70 of the deflecting casing 7. An O-ring 72, placed in the insert 302 is supported against the edge of the orifice 70 and ensures a support and a seal between the insert 302 and the deflecting casing 7 when the screw 30 is tightened.

In the area of the levers Z14, the machine 2 comprises two attachment screws 32, which are inserted through orifices 134 of the casing 12. Each of the screws 32 comprises a screw body 320 having a threading 320*a* brought to engage into a tapping 64 of the frame 6. The screw body 320 comprises a shoulder surface 320*b*. When the screw 32 is tightened, the shoulder surface 320*b* will come into contact with a surface 66 of the frame 6, which forms a spacer between the screw head 320*c* and the frame 6. An O-ring 322, positioned in a groove 320*d* provided under the screw head 320*c*, cooperates with a chamfer 134*a* of the casing 12 for ensuring the seal between the screw 32 and the casing 12, and guarantees accurate placement and centering of the casing 12 relatively to the frame 6 and optimum supports of the seal gaskets 16 and 18 against the frame 6.

According to an alternative not shown, the machine 2 may comprise a different number of attachment screws 32 in the area of the levers Z14.

When the insert 302 is supported against the frame 6 and that the shoulders 320*b* of the screws 32 in the area of the levers Z14 are supported against the surfaces 66, a play J exist between the casing 12 outside the seal areas and the frame 6, so that only the seal gaskets 16, 18 and 28 are flattened against the frame 6, the plates 17 and the crosspiece 15. The play J is visible in FIG. 8 between the casing 12 and a surface 68 of the frame 6.

With the tightening of the screws 30 and 32, the first gasket 16 is uniformly pressed in the mounting direction D12 against the peripheral surface 60*a* forming the horizontal high end of the frame 6, this surface 60*a* being borne by the edge 60, so that the recessed portion 162 of the first gasket 16, positioned outside the peripheral edge 20, is crushed against this surface 60*a* and is centered relatively to the base 160 by the cooperation of the geometries 162*a* and 162*b*. The gasket 16 is then deformed between the peripheral surface 60*a* and a curve cavity 124*a* which forms the end surface of the intermediate edge 124 and which fits the geometry of the deformed recessed end 162. The first gasket 16, in cooperation with the casing 12 and the frame 6, forms the external seal barrier B1 with vertical leak-proof contact of the first gasket 16 on the frame 6 and on the casing 12. The contact of the first gasket 16 with the frame 6 is accomplished vertically at a planar peripheral surface without any groove. This external seal barrier extends in an uninterrupted way over the whole periphery of the frame 6 and of the casing 12, except in the vicinity of the passage aperture 120 for the levers 14, in order to form an obstacle at the entry of lint or of any other outer pollution in the tank of the frame 6. The external seal barrier B1 delimits the inner volume V of the machine.

The internal edge 128 follows the edge 60 of the frame. During the placement of the casing 12 on the frame, along the direction D12, the recessed portion 184 of the second gasket 18 comes into contact with the frame 6 and the second gasket 18 is therefore maintained in abutment in the internal peripheral groove 22, in contact with the bridges of material 130, which forces the deformation of the assembly of its recessed portion 184 between the frame 6 and the lateral peripheral surface 128*a* of the internal edge 128, over the whole periphery of the casing 12 and of the frame 6, except in the vicinity of the passage aperture 120 from which emerge the levers. The contact of the second gasket 18 with the frame 6 is accomplished at an internal lateral peripheral surface 60*b* of the edge 60, positioned in the tank of the frame 6, which has a bulge, formed by a thickness greater than the thickness of the edge 60 at the surface 60*a*. The contacting of the second gasket 18 with the internal lateral peripheral surface 60*b* is preferentially accomplished after contacting of the first gasket 16 with the peripheral surface 60*a*. The deformation of the second gasket 18 is accomplished in the lateral direction.

The second gasket 18, in cooperation with the casing 12 and the frame 6, forms the internal seal barrier B2 with lateral leak-proof contact of the second gasket 18 on the frame 6 and on the casing 12. This internal seal barrier B2 extends in an uninterrupted way over the whole periphery of the frame 6 and of the casing 12, except at the passage aperture 120 for the levers 14 in order to form an obstacle at the outlet of oil microdroplets or of an oil mist, from the tank of the frame 6 towards the outside of the machine. The internal seal barrier B2 is contained in the inner volume V and is positioned in parallel and at a distance from the external seal barrier B1 formed by the first gasket 16.

The internal shell 24 is shifted inwards relatively to the internal seal barrier.

The external B1 and internal B2 seal barriers being at a distance from each other, there is therefore no contact between the gaskets 16 and 18 at the seal barriers and an intermediate chamber V1 separates both seal barriers, a phenomenon of migration of oil by capillarity is avoided.

The third seal gasket 28 is pressed vertically uniformly against plates added onto the frame 6 and crosses it 15 attached on the plates 17 and equivalent by screws 36, so that the recessed portion of the third gasket 28, positioned outside the peripheral groove 26, is crushed and is centered, relatively to the base of the gasket 28, by cooperation of complementary geometries in the same way as for the first gasket 16.

The internal rib 24 remains at a distance from the frame 6 while following its edge 60 without a seal or a contact being formed between the internal rib 24 and the frame 6. During weaving operation, the oil projections in the area of the levers Z14, in particular at the rear of the levers 14, on the side opposite to the passage aperture of the levers 120, are contained by the internal shell formed by the internal rib 24, which forms an obstacle and ensures the deflector function. The oil mist released by the machine 2 in the inner volume V rises between the internal rib 24 and the edge 60. The second gasket 18 forms a seal barrier which prevents the oil mist from reaching contact with the first gasket 16. The first gasket 16 forms a seal barrier to external pollutions and in particular to the lint, which remains at a distance from the second gasket 18 and therefore from the oil. Any capillarity is therefore avoided.

The external B1 and internal B2 seal barriers are ensured by seal gaskets rather than by baffles, which limits the areas for retaining oil and reinforces the efficiency of the seal.

The internal and external seal barriers are formed between a same casing 12 and a same frame 6, which simplifies the manufacturing and improves the accuracy in the positioning and in the deformation of the gaskets 16 and 18 for a seal over the whole length of the gaskets, either over the periphery of the casing 12 except in the vicinity of the aperture 120.

The internal rib 24 provided at the periphery of the area of the levers Z14 is integrated onto the casing 12, which limits the number of casings and of deflectors.

The seal gaskets 16, 18 and 28 are each accommodated in a groove of the casing 12. This limits the machinings to be practiced in the frame 6.

The grooves 22 and 20 open towards the bottom of the casing 12, which limits the potential areas for retaining oil. Indeed, the oil which may be introduced into these grooves flows towards the tank of the frame 6 and therefore cannot accumulate.

Both gaskets 16 and 18 will come into contact with the frame 6 respectively in the vertical direction and in the lateral direction, the deformation of the gasket 16 not causing any lateral movement of the casing 12. Both of these gaskets guarantee a seal between the casing 12 and the frame 6 all along the two seal barriers. Both seal barriers are positioned in parallel for facilitating the mounting of the casing 12 and the sealed contacting of the gaskets 16 and 18 with the respective surfaces 60*a*, 124*a* and 60*b*, 128 on which they are pressed. The external seal barrier B1 and the internal seal barrier B2 are shifted along the mounting direction D12 of the casing 12 on the frame 6, with a vertical shift along the direction D12 of the order of 5 mm.

The attachment devices by screws centered relatively to the casing 12 during the screwing guarantee proper positioning of the gaskets 16 and 18 forming the internal and external seal barriers towards the frame 6. The shouldered screws 30 and 32 give the possibility of controlling the crushing of the gaskets 16 and 18. The cooperation of the geometries 162*a* and 162*b* of the first gasket 16 promotes good placement of the gasket 16 against the frame 6 for an optimum seal.

The seal gasket 322 between the attachment screws 32 and the casing 12 avoids leaks at the attachment.

Figure 10:
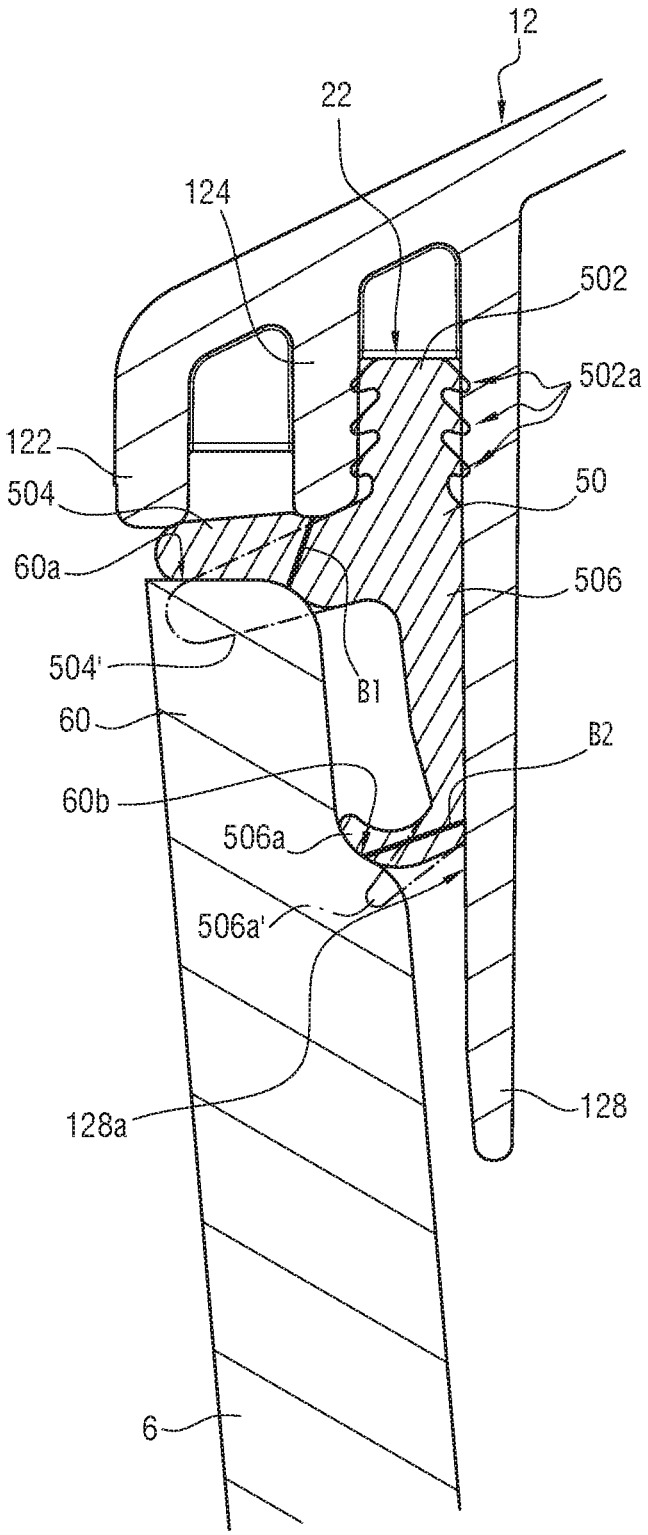
FIG. 10 is a sectional view of one side of a machine for forming the shed according to a second embodiment of the invention.
Figure 11:
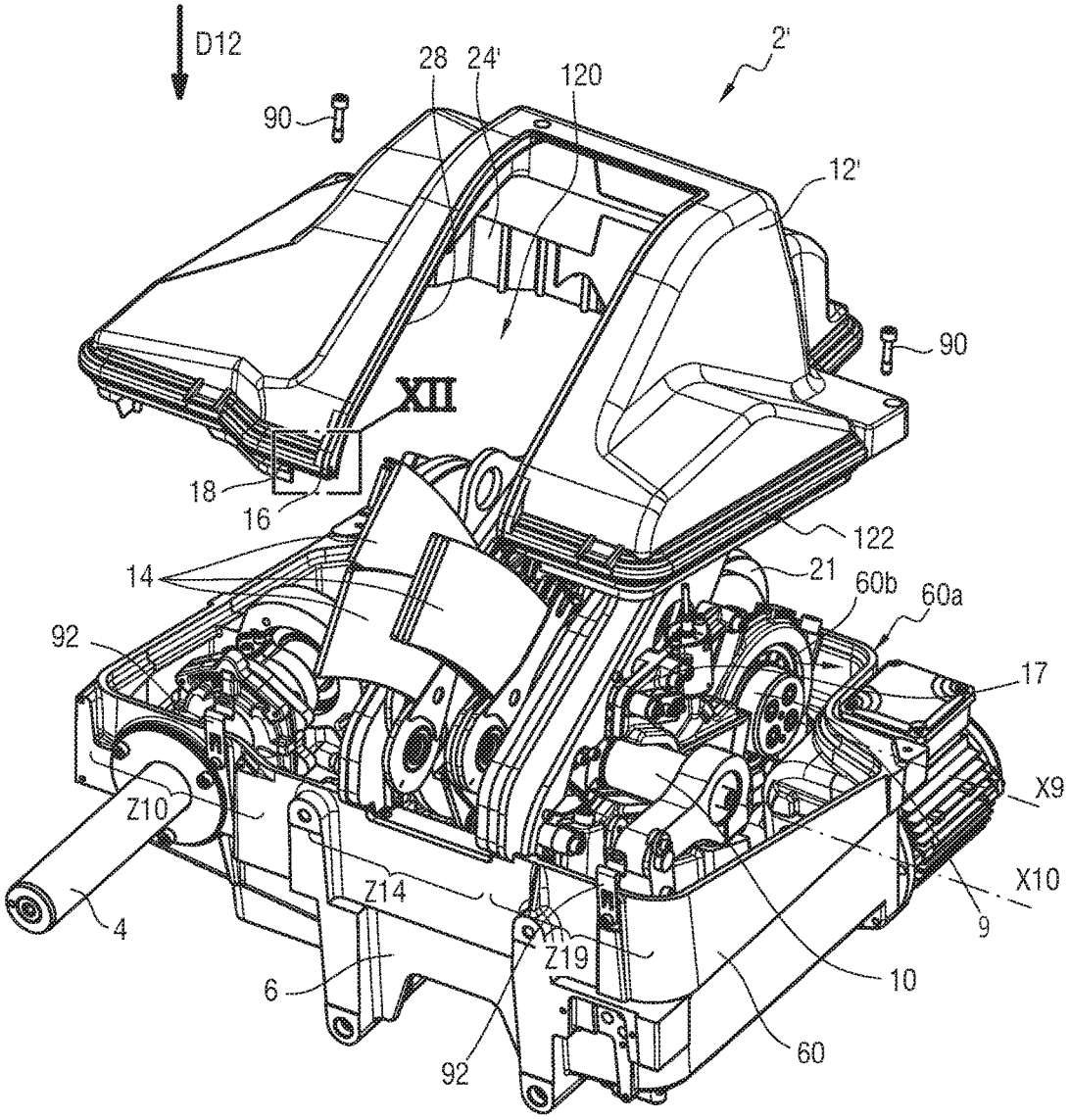
FIG. 11 is a partly exploded perspective view of a machine for forming the shed according to a third embodiment of the invention.
Figure 14:
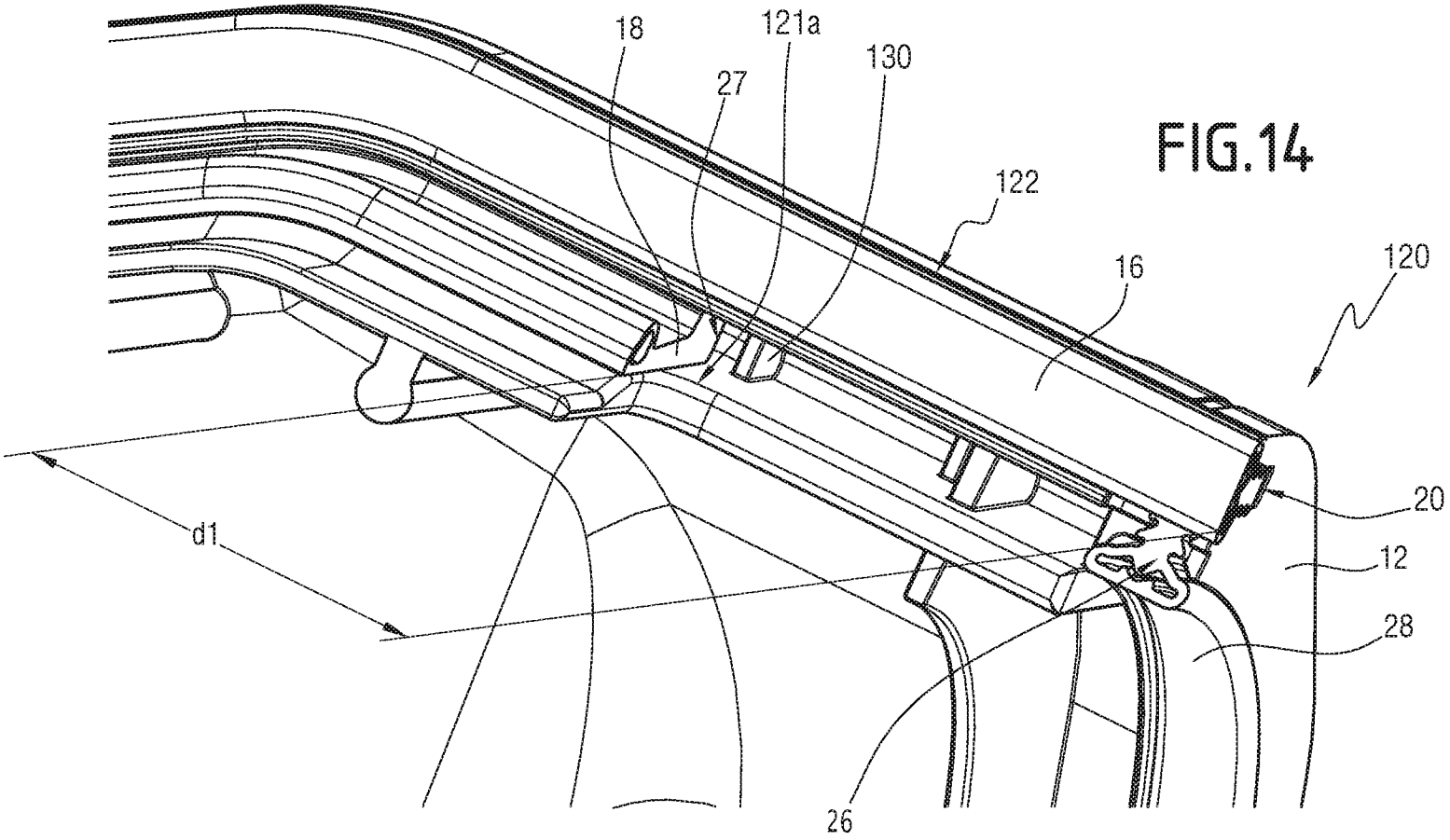
FIG. 14 is a view at a larger scale of the detail XIV in FIG. 12.

FIGS. 10 and 14 represent two other embodiments of the invention. In these embodiments, the elements common to the first embodiment bear the same references and operate in the same way. Only the differences relatively to the first embodiment are detailed hereafter.

In the embodiment of FIG. 10, the external B1 and internal B2 seal barriers are formed by a single seal gasket 50 and each are illustrated by a thick line. In this case, the gasket 50 includes a base 502 provided with lateral lugs 502*a*, forming a profile «as a fir tree», allowing the anchoring in the internal groove 22. The gasket 50 is extended towards the outside of the machine 2 by a lip 504 which will be inserted on the one hand between the external edge 122 and the intermediate edge 124 and on the other hand, the horizontal surface 60*a* of the edge 60 of the frame 6, which ensures a sealed contact in the vertical direction. In the free condition of the gasket 50, the lip 504 is in a free position illustrated by its contour 504'. In the mounted configuration, the lip 504 is deformed between the edge 60 and the edges 122 and 124. The lip 504 gives the possibility of achieving the external seal barrier B1.

The base 502 of the gasket 50 is extended towards the bottom of the frame 6 with a tab 506 terminated by a lip 506*a*, the tab 506 being in contact with the internal edge 128. In a free configuration illustrated by its contour 506*a*', the lip 506*a* has a tilted shape relatively to the tab 506. When the casing 12 is mounted on the frame 6, the lip 506*a* is deformed and curved against the internal lateral peripheral surface 60*b*, which ensures a lateral sealed contact with the frame 6 and the internal edge 128 and forms the internal seal barrier B2.

According to an embodiment not shown of the invention, the machine for forming the shed may comprise two seal gaskets, each forming one of the internal and external seal barriers, which comprise, at their ends, sealed lips similar to those described in FIG. 10 by replacement of the recessed ends 162 and 184.

In the embodiment of FIGS. 11 to 14, a machine for forming the shed 2' operating according to the principle of cam machines (MAF) is illustrated. The driving area Z10 for receiving the torque transmission members between the driving shaft 4 and the actuation shaft 9 is positioned in an adjacent way to the area of the levers Z14 along the axis X10 of the shaft 10, at the driving shaft 4, of a tapered pinion mounted on the shaft 4 and of a tapered wheel mounted on the shaft 9, known per se. Rollers borne by the levers 14 cooperate with cams 21 secured in rotation to the actuation shaft 9 for setting into motion levers 14 by rotation of the actuation shaft 9. The actuation shaft 9 is supported by two plates 17 secured to the frame 6. The actuation shaft 9 extends in the area of the levers Z14. The longitudinal axis X9 of the shaft 9 is parallel to the axis X10. The rollers and cams 21 are also positioned in the area for receiving the levers Z14. In this case, the casing 12' has an internal shell delimited by an internal rib 24' comprising a portion 242 extending towards the rear of the area of the levers Z14, on the side opposite to the passage aperture of the levers 120 and extending with a portion 244 extending at the periphery of the driving area Z10, in parallel with the internal edge of the casing 12 delimiting the groove for the second gasket 18. The internal rib 24' is completed with a portion 246 forming a transverse rib separating the volume dedicated to the area of the rollers, of the cams and of the levers Z14 and the volume of the driving area Z10. In the inner volume V, on the side opposite to the driving area relatively to the area of the levers Z14 a leveling area Z19 extends, comprising means for displacement of the shaft 10 relatively to the plates 17 during the leveling of the levers 14. The first and second gaskets 16, 18 are positioned at a distance and in parallel on the whole periphery of the casing 12 where they each form an internal, external seal barrier not shown, except in the vicinity of the passage aperture 120.

Figure 12:
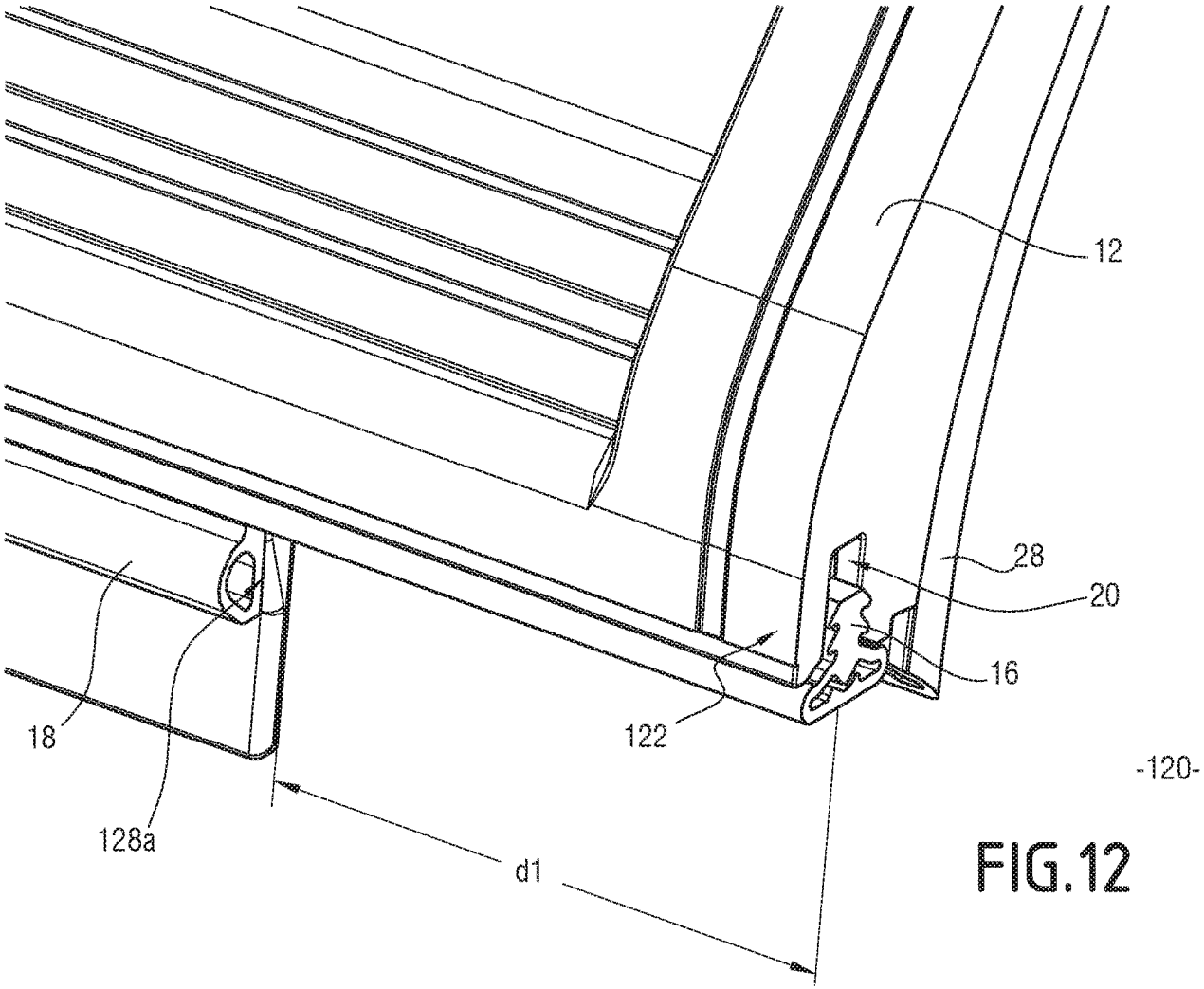
FIG. 12 is a view at a larger scale of the detail XII in FIG. 11.
Figure 13:
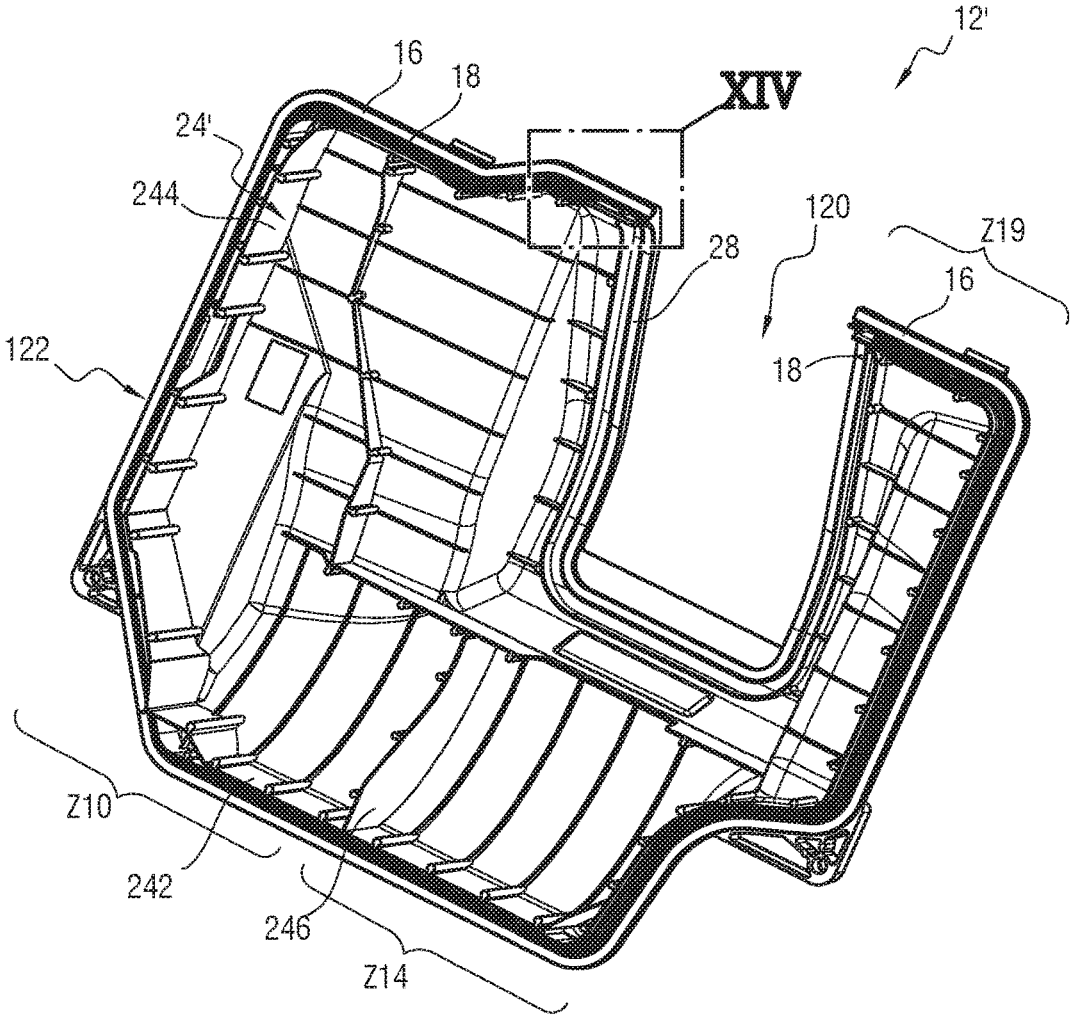
FIG. 13 is a bottom perspective view of a casing of the machine of FIG. 11.

In particular, as is shown by FIG. 12, the internal edge 24 and therefore the second gasket 18 are interrupted at a distance d1 from the aperture 120 of the order of 10 to 70 mm, while the first gasket 16 runs as far as the aperture 120. In this case, both internal and external seal barriers also each extend over the whole periphery of the casing 12 except at the aperture 120, i.e. facing this aperture 120 as well as over the distance d1, facing the notch which is contiguous to the aperture 120.

In this embodiment, the casing 12' is secured to the frame 6 with two attachment screws 90 and two attachment clamps 92. The screws 90 will be supported against the casing 12 and are screwed, through a protrusion of the external edge 122 of the casing 12, into the frame 6, they do not cross the inner volume V of the machine 2'.

According to an embodiment not shown, the lower end of the internal rib may be immersed, at least over certain length portions, in the oil bath at the bottom of the tank of the frame 6.

According to another embodiment not shown, the seal gaskets 16, 18 and 28 may be made in an elastomeric material as an alternative to silicone.

According to another embodiment not shown, the driving shaft 4 is an output shaft of the weaving loom or of a motor.

According to another embodiment not shown, at least one of the gaskets forming the seal barriers B1 and B2, for example the gasket 16, may not comprise a base inserted into a groove of the casing 12 but a base adhesively bonded on a peripheral surface of the casing 12. Both gaskets 16 and 18, or else the gasket 50, may be attached in this way.

The invention claimed is:

1. A machine for forming the shed, of the dobby or cam machine type for a weaving loom, the machine comprising:

output levers performing, during weaving, an alternating oscillation movement around a common shaft, a casing with an output aperture crossed by the levers, a frame which delimits, with the casing, an inner volume of the machine comprising an area for receiving torque transmission members between a driving shaft and an actuation shaft for actuating the output levers as well as an area for receiving output levers, the receiving area of the output levers being adjacent to the area for receiving torque transmission members, and the frame supporting the actuation shaft;

wherein the casing and the frame are in contact, via at least one seal gasket, at both seal barriers external and internal respectively, distant from each other, both seal barriers each extending over the whole periphery of the casing except at the output aperture.

2. The shed-forming machine according to claim 1, wherein the internal and external seal barriers are positioned in parallel to each other.

3. The shed-forming machine according to claim 1, wherein a first seal gasket forms the external seal barrier and a second seal gasket forms the internal seal barrier.

4. The shed-forming machine according to claim 1, wherein at least one seal gasket of the external and internal seal barriers has a recessed end able to be deformed between the casing and the frame.

5. The shed-forming machine according to claim 4, wherein the recessed end defines a closed profile having two internal centering geometries adapted for cooperating with each other by a complementarity of shapes when the recessed end is deformed between the casing and the frame.

6. The shed-forming machine according to claim 1, wherein at least one or each seal gasket of the external and internal seal barriers comprises a base accommodated in a peripheral groove of the casing.

7. The shed-forming machine according to claim 6, wherein the groove(s) open(s) along a direction for mounting the casing on the frame.

8. The shed-forming machine according to claim 1, wherein the external seal barrier is made between a horizontal end peripheral surface of an edge of the frame and a peripheral end surface of an edge of the casing.

9. The shed-forming machine according to claim 1, wherein the internal seal barrier is made between a lateral peripheral surface of an edge of the frame and a peripheral lateral surface of an internal edge of the casing.

10. The shed-forming machine according to claim 9, wherein the seal gasket forming the internal seal barrier comprises a base inserted into a groove of the casing and a tab extending from the base as far as an end of this tab in contact with the frame, the surface of this tab flattened against the internal edge of the casing in a mounted configuration forming, in the free state of the seal gasket, an angle with the base strictly less than 180°, preferably equal to 175°.

11. The shed-forming machine according to claim 1, wherein the external seal barrier and the internal seal barrier are shifted along a direction for mounting the casing on the frame.

12. The shed-forming machine according to claim 1, wherein the casing includes an internal rib, forming a shell shifted inwards relatively to the internal seal barrier, this internal rib extending at least at the rear of the area for receiving the levers and between the area for receiving the levers and the driving area.

13. The shed-forming machine according to claim 1, wherein the casing is attached on the frame by shouldered screws, a seal gasket being interposed between each shouldered screw and the casing.

14. The shed-forming machine according to claim 13, wherein at least one of the shouldered screws is inserted into an orifice of the casing for which the edges have a chamfer, and wherein the gasket ensuring the seal between this shouldered screw and the casing is pressed between a head of this shouldered screw and said chamfer.

15. A weaving loom comprising a shed-forming machine according to claim 1.

* * * * *